US006080057A

United States Patent [19]

Bell et al.

[11] Patent Number: 6,080,057

[45] Date of Patent: Jun. 27, 2000

[54] COIN DISPENSING MECHANISM HAVING A PEG AND GROOVE CONFIGURATION

[75] Inventors: Mike Bell, Leeds; Mark Paling, Oldham, both of United Kingdom

[73] Assignee: Coin Controls Limited, Lancashire, United Kingdom

[21] Appl. No.: 08/983,512

[22] PCT Filed: Jul. 25, 1996

[86] PCT No.: PCT/GB96/01793

§ 371 Date: Mar. 19, 1998

§ 102(e) Date: Mar. 19, 1998

[87] PCT Pub. No.: WO97/05581

PCT Pub. Date: Feb. 13, 1997

[30] Foreign Application Priority Data

Jul. 28, 1995 [GB] United Kingdom ..... 9515567

[51] Int. Cl.[7] ..... G07D 1/00

[52] U.S. Cl. ..... 453/57; 221/203

[58] Field of Search ..... 453/57, 49, 6, 453/10; 221/203, 182

[56] References Cited

U.S. PATENT DOCUMENTS

| | | | |
|---|---|---|---|
| 2,906,276 | 9/1959 | Blanchette et al. | 453/6 |
| 3,422,824 | 1/1969 | Persson | 453/57 |
| 4,978,322 | 12/1990 | Paulsen | 453/57 |

FOREIGN PATENT DOCUMENTS

| | | | |
|---|---|---|---|
| 2296361 | 7/1976 | France | 453/6 |
| 157642 | 3/1991 | Japan . | |
| 162386 | 7/1991 | Japan . | |
| 171084 | 10/1991 | Japan . | |
| 187498 | 7/1992 | Japan . | |
| 1454473 | 11/1976 | United Kingdom | 453/57 |

*Primary Examiner*—Robert P. Olszewski
*Assistant Examiner*—Bryan Jaketic
*Attorney, Agent, or Firm*—Arent, Fox, Kintner, Plotkin & Kahn

[57] ABSTRACT

The front face (20) of a disc (21) has a plurality of coin capturing pegs (22) spaced apart around its periphery. When the disc is rotated in a hopper, the pegs (22) capture coins and raise them to a dispensing point. The disc (21) cooperates with a wiping arm (25) having a pair of protrusions (26 and 27) arranged to locate the grooves (23 and 24) to provide a barrier which prevents coins from getting between the disc (21) and the arm (25).

16 Claims, 13 Drawing Sheets

COIN DISPENSING MECHANISM HAVING A PEG AND GROOVE CONFIGURATION

FIELD OF THE INVENTION

The invention relates to dispensing mechanisms and more particularly, but not exclusively, to a coin or token handling mechanism for use in vending machines, amusement or gaming machines, change giving machines or any other machine that requires a pay out of coins or tokens to be made, for instance in the form of a prize or as change.

For simplicity, the word coin used in the specification represents both coins and tokens.

BACKGROUND OF THE INVENTION

One known type of coin dispensing mechanism comprises a hopper containing a rotatable disc, the plane of the disc being inclined at an angle to the vertical. The disc carries pegs and as the disc rotates, coins in the hopper are captured between the pegs and are lifted in a position in which they rest against the face of the disc.

In the upper region of the disc there is a wiping arm which guides coins along the arm and into an exit duct for subsequent dispensing. FIGS. 1 and 2 show such a prior art device, with a hopper 10, disc 11, pegs 12, wiping arm 13 and exit duct 14.

With the prior art device, a problem occurs in that coins can get stuck between the back of the wiping arm 13 and the front face of the disc 11. The top face of the wiping arm is slightly sloped towards the disc to discourage coins falling off. However, in biasing a coin, an equal and opposite force is applied on to the wiping arm, causing it to move slightly away from the disc. During normal coin dispensing, this does not cause a problem, but if a coin is reluctant to move along the wiping face, for example because it is bent or otherwise damaged, the forces involved increase. The result can be that the coin can wedge into the gap between the disc and the back of the wiping arm. This jams the mechanism so badly that it usually has to be removed from the host machine, stripped down, re-built or re-set (usually with a new wiper arm) and re-fitted back into the host machine. The host machine is out of order for this lengthy duration.

Furthermore, the existing wiping arm arrangement is not self-adjusting and so relies heavily on the disc being stable during rotation. The arm cannot adjust for wear and so becomes more prone to jamming, as more and more coins are dispensed.

SUMMARY OF THE INVENTION

We have developed an improvement to the known mechanism which will significantly improve the reliability and hence the lifespan of the product.

Accordingly the invention provides a coin dispensing mechanism comprising a rotatable plate and a cooperating guide to guide coins off the plate, there being a groove and protrusion interconnection between the plate and the guide to perform a control function on coins which are transported to the guide by rotation of the plate.

According to one embodiment, a rotatable disc may be used with a wiping arm, as with the prior art arrangement. However, one or more concentric grooves will be provided in the front face of the disc, for example by machining. Coins can rest against the non-grooved portions of this space for transport in the usual manner. The back of the wiping arm can be provided with protrusions which extend into the newly formed space provided by the grooves.

In a sense, part of the back face of the wiping arm has been extended beyond the front face of the disc. Thus, even if the wiping arm is pushed away from the disc, there is still engagement between the grooves and the protrusions forming a barrier preventing coins from jamming between the disc and the arm.

The protrusions and grooves may have any desired cross-sectional profile.

Furthermore, the profile of one groove and cooperating protrusion may differ from the profile of another groove and protrusion when there is more than one groove and protrusion on the same apparatus.

While the invention has particular advantages when used with the type of prior art mechanism shown in FIGS. 1 and 2, the invention also enables two further major developments.

Firstly, the protrusions may be arranged not just to prevent coins jamming, but to guide the coins to an exit duct, thus eliminating the need for the prior art type of wiping arm.

According to this embodiment, the protrusions comprise one or more fixed pegs, arranged to engage respectively in one or more grooves in a disc in a manner not only to prevent coins from jamming between the pegs and the disc, but also to restrict movement of a coin, so that the coin being dispensed has to move around the pegs and towards an exit duct. Coins are in effect dispensed by being squashed between moving pegs on the disc and the fixed wiping pegs.

The wiping pegs themselves, and also the way in which they extend across the disc, can be adjusted to guide the coins in any desired manner and in particular to adopt a convenient direction for dispensing of the coins from the disc to an exit duct. This has further advantages, as will be explained later.

The second major additional development which is made possible by the use of protrusions and grooves is that the profile of the disc can be changed.

The prior art arrangement shown in FIGS. 1 and 2 utilizes a flat disc 11. The problem with a flat coin dispensing disc is that the mounting angle (usually 60° to the horizontal) is a compromise between the coin pick up and the coin dispensing areas, as can best be seen from FIG. 2. If the angle of the disc is too steep, then the rate of coin pick up from the storage area at the base of the hopper can reduce to nothing. If, however, the angle is too shallow, then too many coins flood into the dispensing area making a jam more likely.

A disc type dispensing mechanism can also be used with a coin escalator such as that shown at 15 in FIG. 2. Coins within the escalator are more prone to jam at a bend such as that shown at 16, and so elimination or reduction of these bends is highly desirable.

Non-flat discs have not been used before because it has proved impossible to provide a wiping arm which accurately mimics the non-flat profile of the disc. Gaps have inevitably occurred resulting in the type of terrible jam described above.

The cooperating protrusion and groove concept of the invention means that protrusion profile and groove depth can be adjusted, so that the protrusions extend below the surface of the disc. It is no longer necessary to accurately mimic a surface profile, since the grooves and protrusions cooperate to prevent jams.

According to one embodiment, a frusto-conical disc is provided, arranged so that coins are conveyed on the frustum of the cone. This has the effect that the frustum can have a relatively shallow angle in a coin pick up area. In addition, or alternatively, the frustum can be arranged to have a relatively steep angle in a coin dispensing area.

If a frusto-conical disc is used in conjunction with an escalator, the angle of the coin dispensing area may make it possible to eliminate or substantially reduce the bend such as that shown at 16 in FIG. 2.

It will be seen from FIG. 2 that the coins also have to change direction in the region marked 17 in FIG. 2. If, however, the protrusions and grooves are used to guide the coins, as well as prevent jams, the exit direction of the coins may be selected in such a way as to eliminate or reduce the angle of the direction change at the point 17.

The cross-sectional profile of the disc may be selected for optimum efficiency in any given situation. Using a frusto-conical disc it may, for example, be possible to provide a coin pick up angle of the order of 30° and a coin dispensing angle of the order of 90°, with respect to the horizontal. One possibility would be to make up the frustum of the cone by a series of flats. These flats could also be sloped from front to back causing a step between the flats that engages and captures coins in a similar way to the pegs on the prior art disc. Coins can be dispensed with the stepped wall pushing the coin during dispensing.

Alternatively, the disc profile form could be of the same radius in both planes (a perfect sphere) in whole or part. There are other advantages in having a flat coin sitting on a perfect sphere, since a flat coin then rests on its entire circumference and does not rock.

Another advantage of utilizing a frusto-conical disc is that a lip can be provided which acts on the rim of coins held between the pegs, so as to bias the coin to lean into the disc. The cone profile means that the coin is slightly tilted away from the disc outer and towards two contact points with the disc. This makes the coins less prone to fall off the disc during dispensing.

The above features of the invention may be used in any desired combination. For example wiping pegs could be used in conjunction with a wiping arm, with or without protrusions. For example, pegs could be used to commence the coin dispensing operation with a fixed wiping arm concluding the operation.

Such an arrangement would be possible with both flat and non-flat discs.

Yet another advantage of the groove and protrusion concept is that it makes stability of the disc less critical. It is thus possible to guide the disc utilizing a friction bearing or thrust washer, whereas the prior art discs have to be guided using a ball race and a spring-loaded disc to provide the necessary stability. The ball race has to be greased and coin dust from the coins entering the grease effectively turns it into a grinding paste. This causes heavy wear on the engaging parts and shortens product life and reliability.

The invention makes it possible to utilize a friction bearing or thrust washer as already mentioned, which is not only cheaper, but could be a longer lasting alternative. No grease need be required, since the friction bearing can be self-lubricating.

The friction bearing or thrust washer can be mounted between the back of the rotating disc and a fixed mounting frame. Rollers could be used instead.

According to another aspect of the invention, a disc of smaller dimensions is used, such that as coins travel around with the disc, they overhang part of the dispensing circumference. This can make it easier to dispense a coin as it has less distance to travel before it is completely off the disc.

According to another aspect of the invention, an alternative means is provided for guiding coins around a bend in an escalator, such as that shown at 16 in FIG. 2, for those situations where such a bend cannot be eliminated entirely.

According to this aspect of the invention, a coin escalator is provided, having a bend therein, spring-loaded balls being provided to act on the faces of coins to control the location and movement of the coins as they travel round the bend.

Another aspect of the invention relates to the retention of coins in a coin escalator, to prevent all the coins from falling back out of the escalator, should the supply of coins from the hopper cease, for example if the direction of rotation of the disc is reversed, for example in an attempt to clear a jam.

The prior art arrangement utilizes two devices, namely a stop member 18 and a sprag clutch 19.

We have discovered that it is possible to eliminate one of these devices by positioning a sprag clutch at the location 18. Not only does a sprag clutch positioned adjacent to the disc assist in retaining coins in the escalator, but it also keeps coins stable as they leave the disc, so that following coins are less likely to slide past it and jam.

According to another aspect of the invention, a coin escalator is provided comprising a channel having a base and side walls, a coin retaining strip extending from one of the side walls over the mouth of the channel.

The width of the strip is preferably greater than half the width of the channel.

Prior art escalators utilize a channel in which a small lip extends from each side wall of the channel. This can, however, cause jamming problems with bent coins. These escalators rely on the coins being dispensed to be flat.

The escalator according to this aspect of the invention enables bent coins to rock slightly, thus avoiding jamming.

The base of the channel may be curved in such a manner as to further assist the accommodation of bent coins.

A curved profile is also useful with the aspect of the invention which utilizes spring-loaded balls to guide coins round a bend.

Alternatively, fulcrum points, to assist coin tilting, may be arranged in the base of the channel and/or on the retaining strip.

These allow the coins to twist relative to touching coins on either side. This reduces the possibility of coins sliding past each other and jamming.

By controlling the width available at the same center line where the coins touch each other, the escalator does not rely on the coins being flat to work i.e. bent/worn coins are less likely to cause a jam.

According to yet another aspect of the invention, a coin escalator is provided having means to count coins being dispensed from the escalator, the counting means comprising a cooperating signal transmitter and signal receiver. The signals may be light signals.

According to one final aspect of the invention, a coin escalator is provided having means to count coins being dispensed from the escalator, the counting means comprising a mechanical arm positioned such that coins being dispensed travel over the arm and depress the arm downwardly.

A prior art product has a mechanical arm mounted above the coin being ejected for the escalator. This wastes valuable height between the top of the coin being ejected and the physical top of the mechanism. Positioning the arm below the coin being ejected means that the distance between the top of the coin ejected and the top of the escalator is minimized by as much as several millimeters.

Whilst various aspects of the invention have been defined above, it is emphasized that the primary aspect of the invention concerns the concept of utilizing grooves and projections cooperating between a rotatable dispensing plate and coin guide means.

Yet another useful aspect of the groove and projection concept is that arrangements can be made to flick off unwanted coins already captured on a disc. This could be used, for example, when a disc is rotated in the reverse direction to the dispensing direction, to provide an additional anti-jam feature. With the prior art arrangement shown in FIGS. 1 and 2, such reverse movement is likely to cause coins to ram into the back of the wiping arm, producing a jam.

According to the invention, a second guide means, for example a second fixed wiping arm or arms could be arranged with one or more fingers running in one or more grooves. These may be arranged to get underneath the coin and, as the disc rotates in the reverse direction, lift the coin away from the disc. It would thus be possible to rotate the disc continuously in the opposite direction to the normal coin dispensing direction until any jams have been cleared.

Although specific reference has been made to the use of protrusions in the form of pegs, other forms of protrusion may be used appropriate to the circumstances, including for example tabs or indents.

According to another aspect of the invention, coins can be discouraged from flooding the disc dispensing area shown in FIG. 2 by the use of one or more flexible wiping members. These protrude into the hopper bowl 10 and are positioned before the coin dispensing area. Their purpose is to deflect coins not engaged between the pegs 12 away from the dispensing area. Each wiping member comprises a prong (e.g. spring steel) that makes contact with the coins. The prong does not form a rigid barrier to the coins as that could result in a stalled disc and hence jam. Heavily loaded prongs can bend out of the way under this load, and then spring back to the initial position. The wiping members could comprise a series of rows of prongs. The, or each, flexible wiping member may be mounted on any convenient fixed part of the apparatus.

BRIEF DESCRIPTION OF THE DRAWINGS

By way of example, specific embodiments of the invention will now be described, with reference to the accompanying drawings, in which.

DESCRIPTION OF THE PREFERRED EMBODIMENTS

Figure 1:
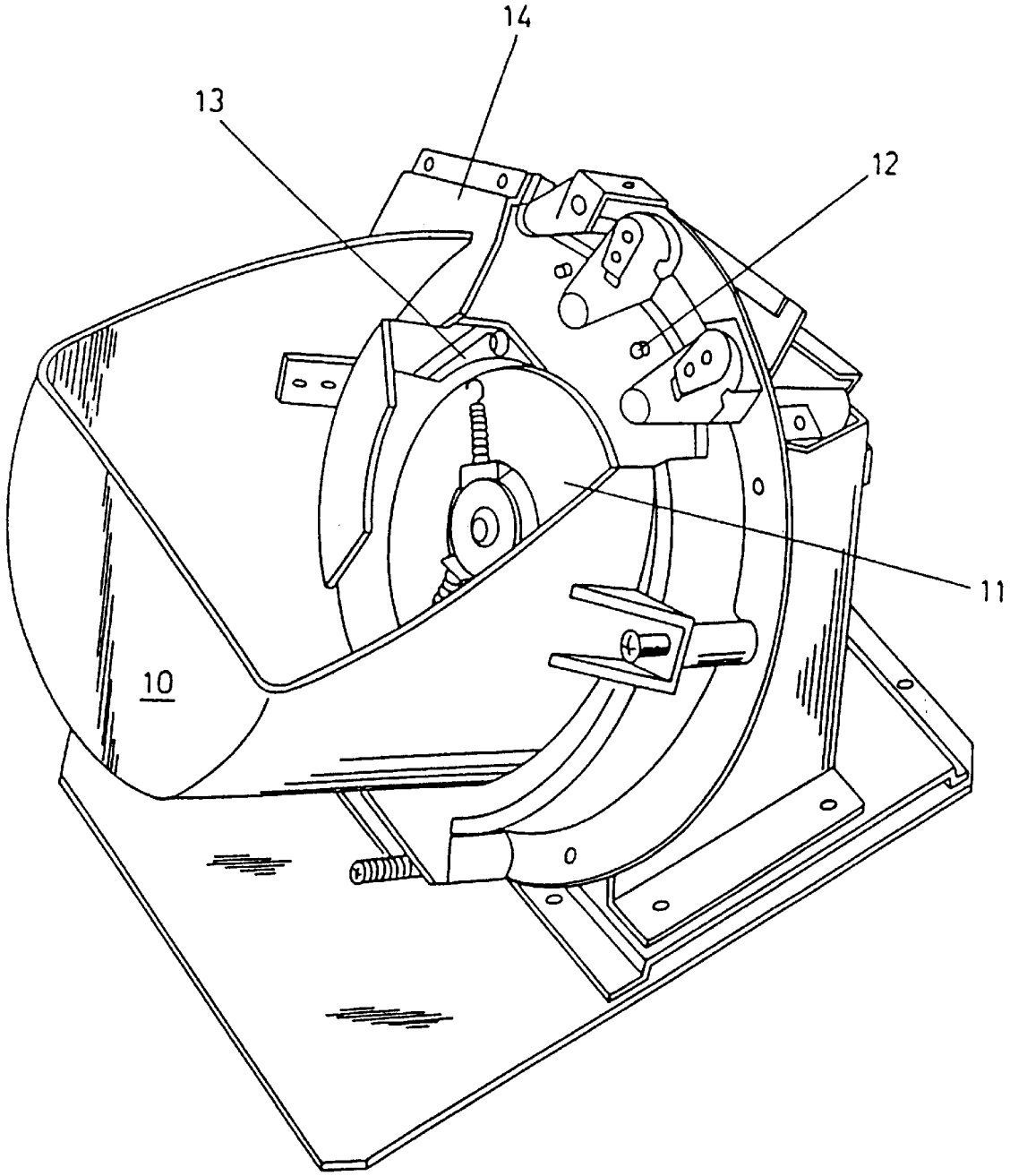
FIG. 1 PRIOR ART
FIG. 1 shows a prior art coin dispersing device.
Figure 2:
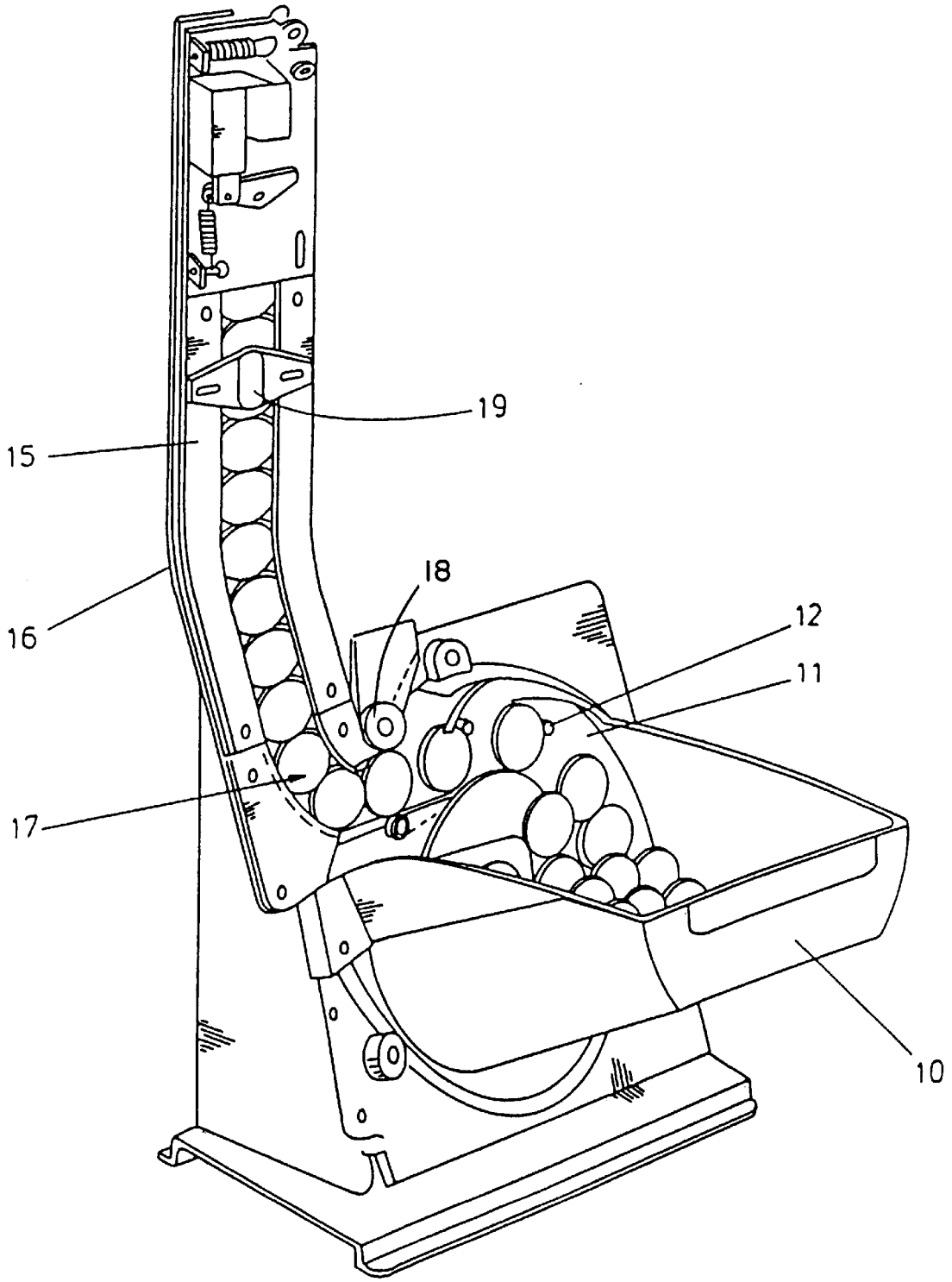
FIG. 2 PRIOR ART
FIG. 2 shows another view of the prior art device shown in FIG. 1.
Figure 3:
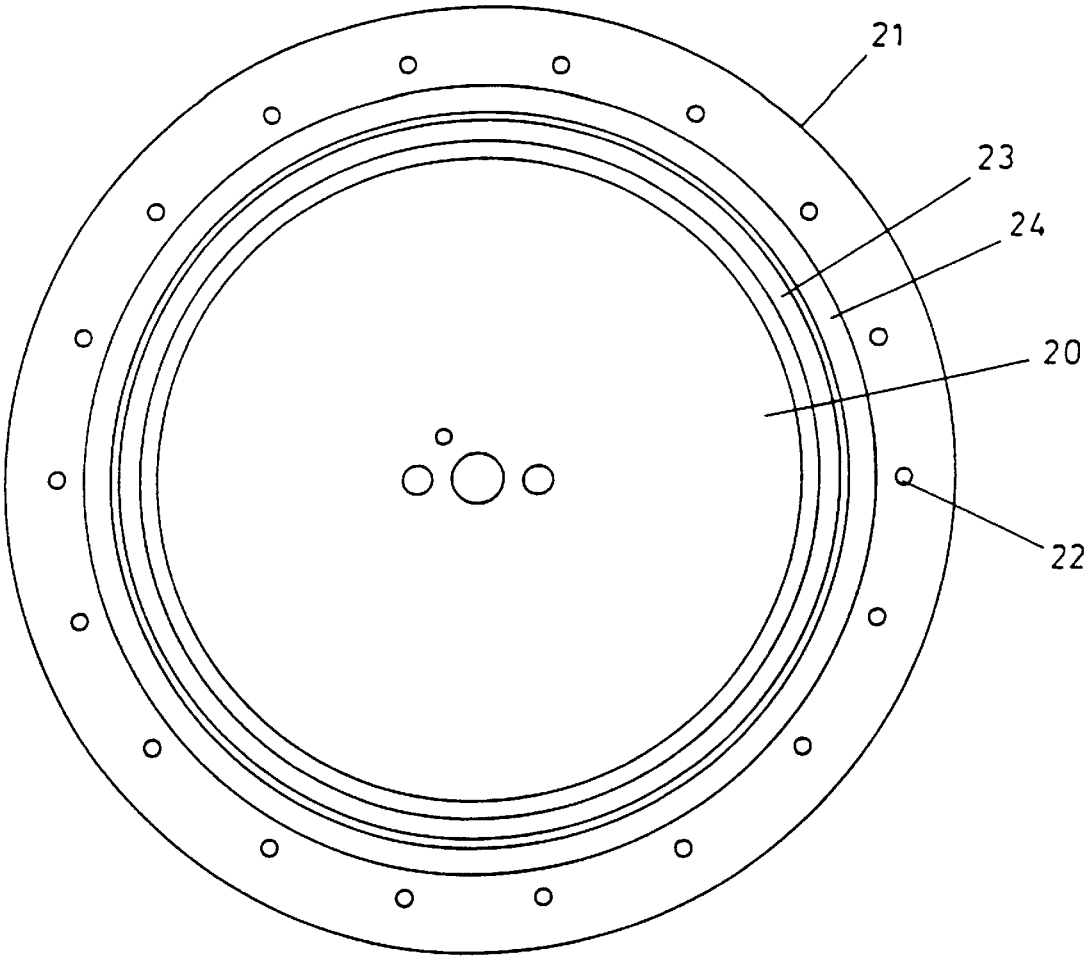
FIG. 3 is a face view of a flat disc of an embodiment of coin dispensing mechanism according to the invention.
Figure 4:
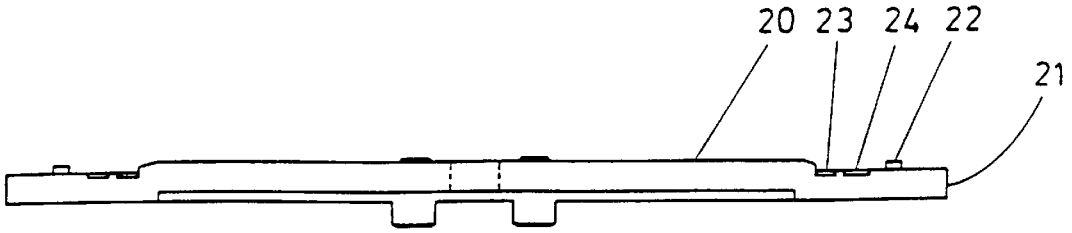
FIG. 4 is an edge view of the flat disc shown in FIG. 3.

The disc shown in FIGS. 3 to. 5 is intended for use with a coin dispensing mechanism of the general type shown in FIGS. 1 and 2. The front face 20 of the disc 21 has a plurality of coin capturing pegs 22 spaced apart around its periphery.

When the disc is rotated in a hopper such as that shown at 10 in FIG. 1, the pegs 22 capture coins and raise them to a dispensing point.

The disc shown in FIGS. 3 to 6 differs from prior art discs in that it has two concentric grooves 23, 24 machined into its front face.

Figure 5:
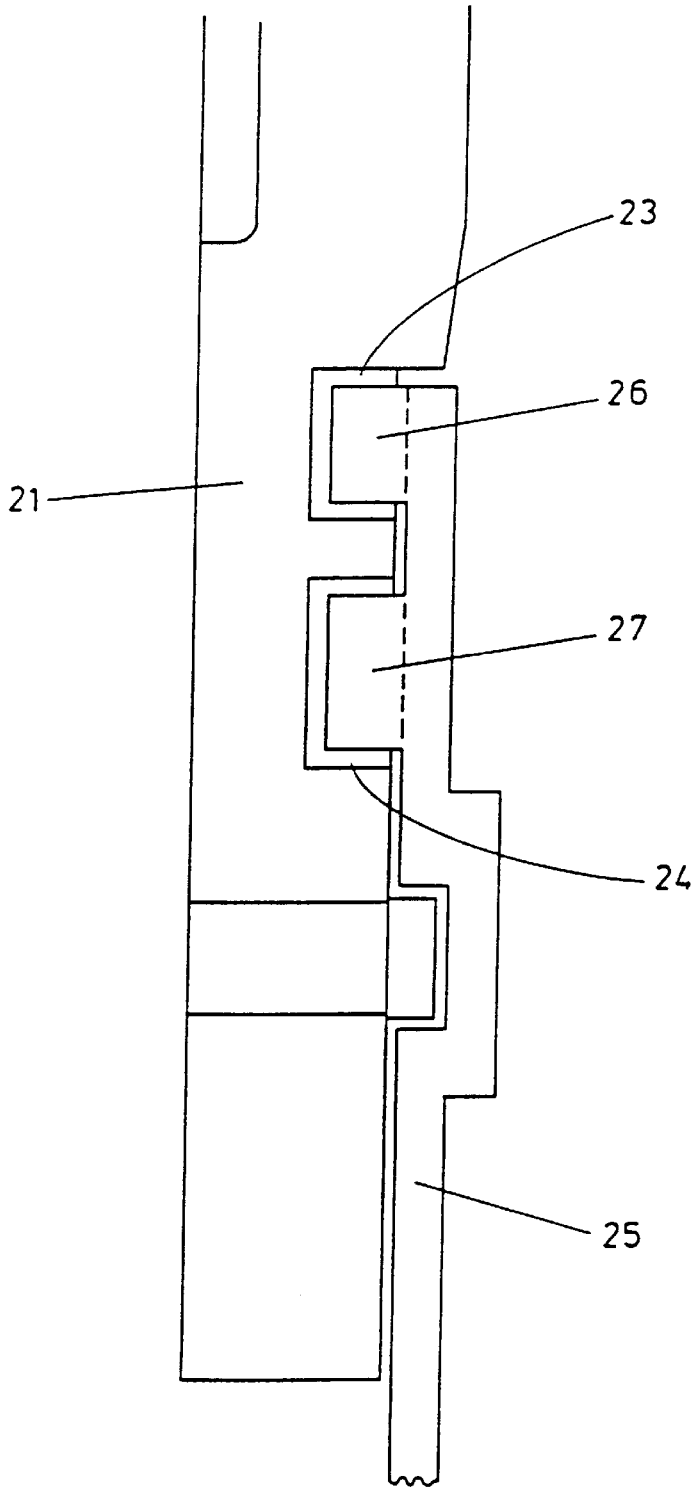
FIG. 5 is an edge view of the disc of FIGS. 3 and 4 utilized in one embodiment of coin dispensing mechanism according to the invention.

In FIG. 5, the disc 21 is shown cooperating with a wiping arm 25, which is generally similar to that shown in FIG. 1, but has a pair of protrusions 26 and 27 arranged respectively to locate in the grooves 23 and 24. The protruding pegs 26 and 27 provide a barrier which prevent coins from getting between the disc 21 and the arm 25, even if the arm 25 moves away from the disc 21 slightly.

Figure 6:
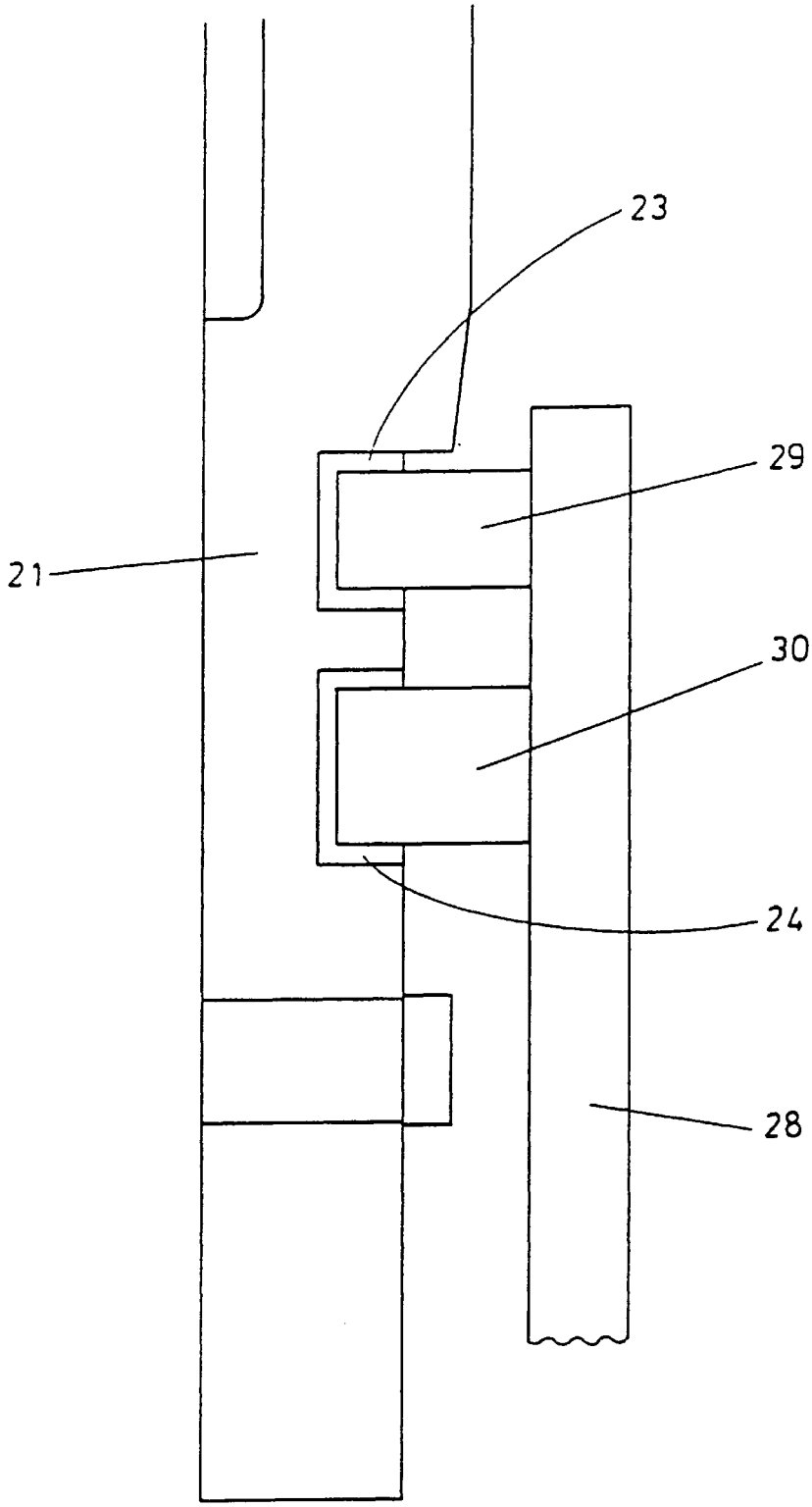
FIG. 6 is a view similar to FIG. 5, but showing the disc of FIGS. 3 and 4 utilized in a further embodiment of the invention.

In the embodiment shown in FIG. 6, the disc 21 cooperates not with a conventional wiping arm but with a support member 28 which carries guide pegs 29 and 30 which engage respectively in the grooves 23 and 24. The pegs 29 and 30 can be used not only to prevent coins getting between the two components and jamming, but can also be arranged to direct coins along a desired path.

Figure 7:
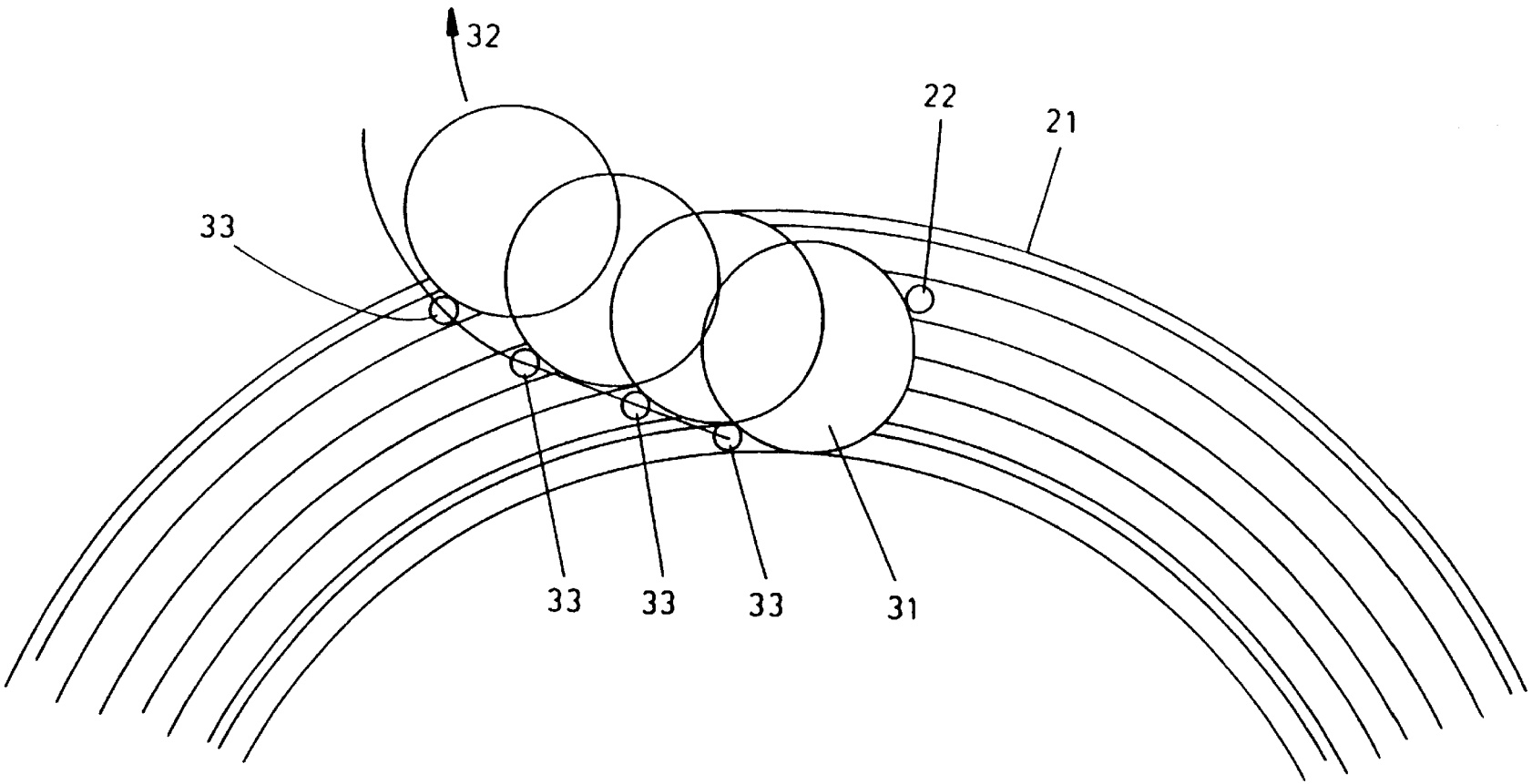
FIG. 7 is a part face view of a disc utilized in the embodiment of FIG. 6.

Such an arrangement is shown in FIG. 7. As the disc 21 rotates, a coin 31 is conveyed towards a dispensing point by one of the moving pegs 22. The figure illustrates diagrammatically how the coin 31 can be moved through a series of positions, gradually travelling off the disc and towards an upwardly extending outlet path 32, by an appropriately placed series of fixed guide pegs 33. This makes it possible to substantially reduce the angle through which coins have to be turned at the entrance to a coin escalator such as that shown in FIG. 2.

Figure 8:
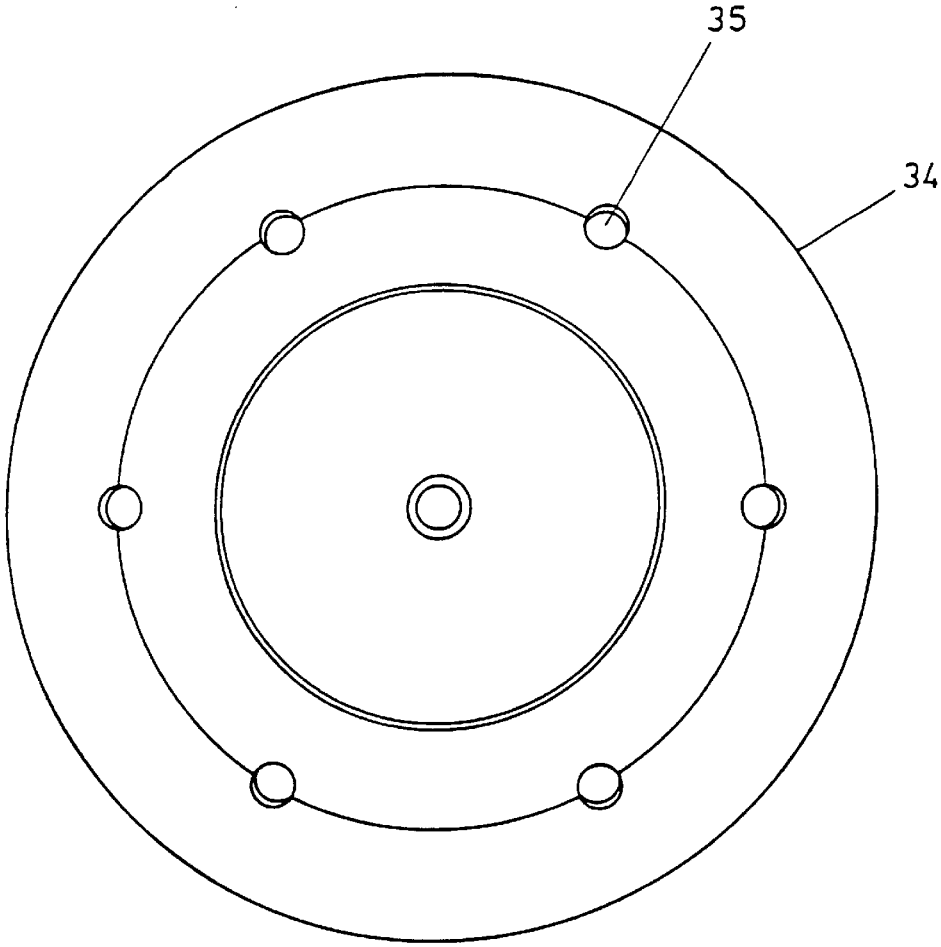
FIG. 8 is a face view of a frusto-conical disc of an embodiment of coin dispensing mechanism according to the invention.

FIG. 8 illustrates an alternative form of disc 34, having coin capturing pegs 35. The disc is frusto-conical, as can be seen from FIG. 9, with coins being captured on the frustum 36.

Figure 9:
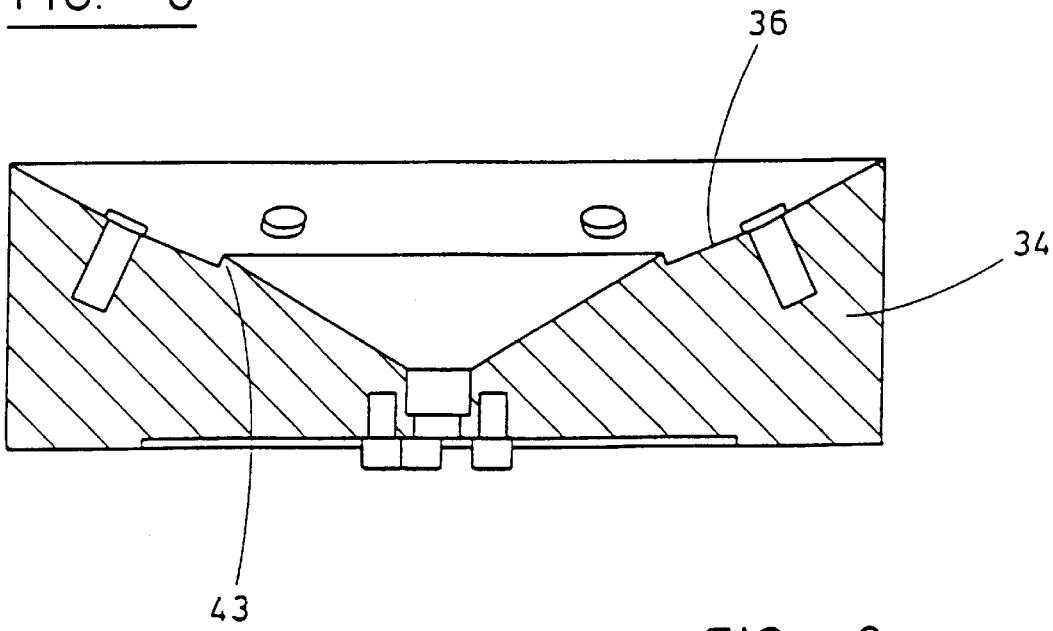
FIG. 9 is a cross-sectional edge view of the disc shown in FIG. 8.

From a comparison between FIGS. 2 and 9, it will be seen that if the disc shown in FIGS. 8 and 9 is mounted at an appropriate angle, the frustum can be at angle of substantially 30° to the horizontal in the coin pick up area, and substantially 90° to the horizontal in the coin dispensing area. This may make it possible to eliminate the bend 16 shown in FIG. 2.

The surface of the frustum may be slightly curved, as shown in FIG. 9, or it may be spherical. A further possibility is to make up the frustum from a series of flats, so that each coin makes full face contact with the disc.

Figure 10:
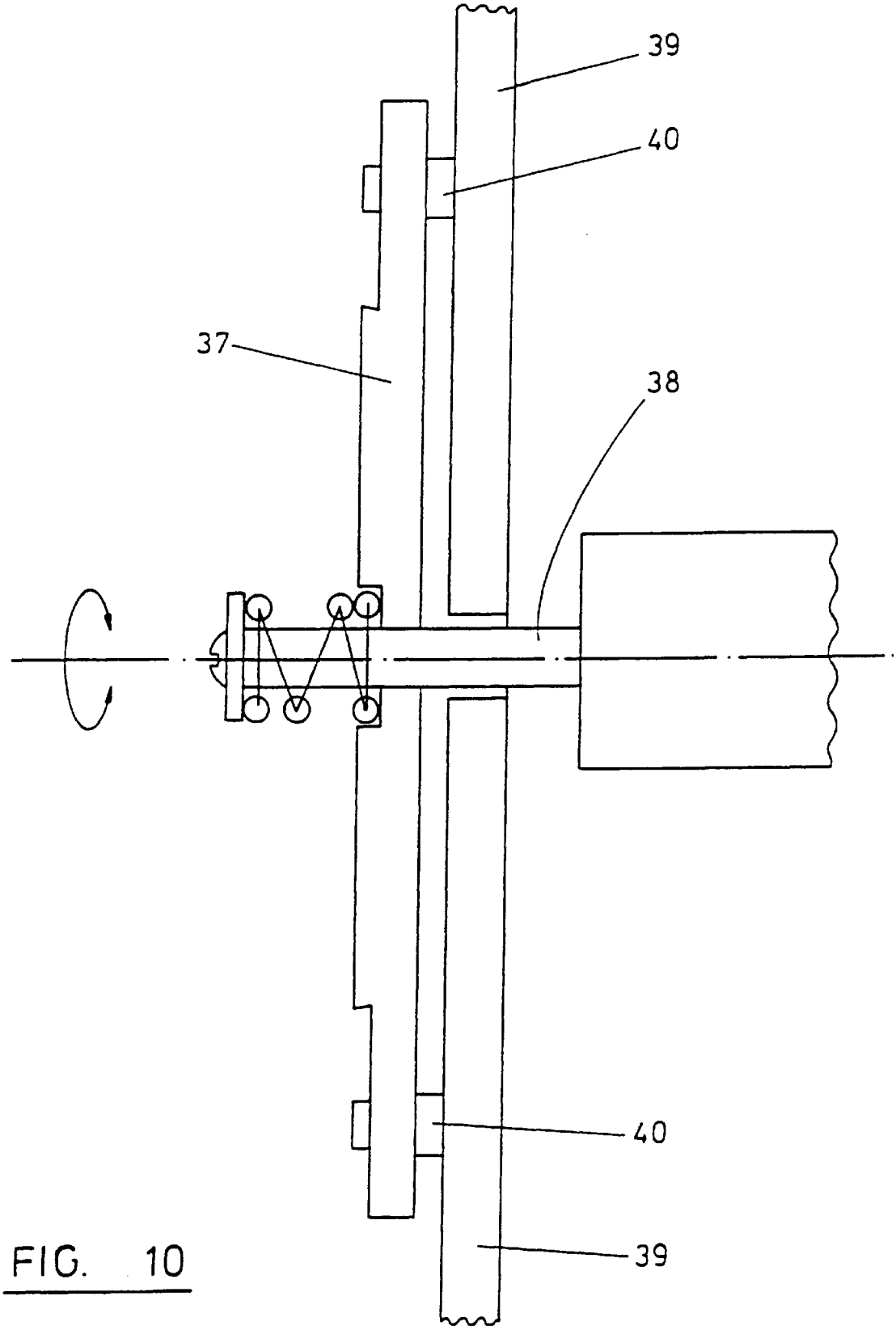
FIG. 10 is an edge view of an embodiment of disc according to the invention, showing details of the mounting of the disc.

A further advantage of the groove and projection arrangement is that precise mounting of the disc is less critical. In the embodiment shown in FIG. 10, for example, a disc 37 is mounted on a rotatable shaft 38 against a fixed back plate 39. A thrust bearing 40 is provided between the disc and the back plate and it may be possible to use a simple self-lubricating friction washer. This is not only cheaper, but reduces disadvantages associated with known ball races.

Figure 11:
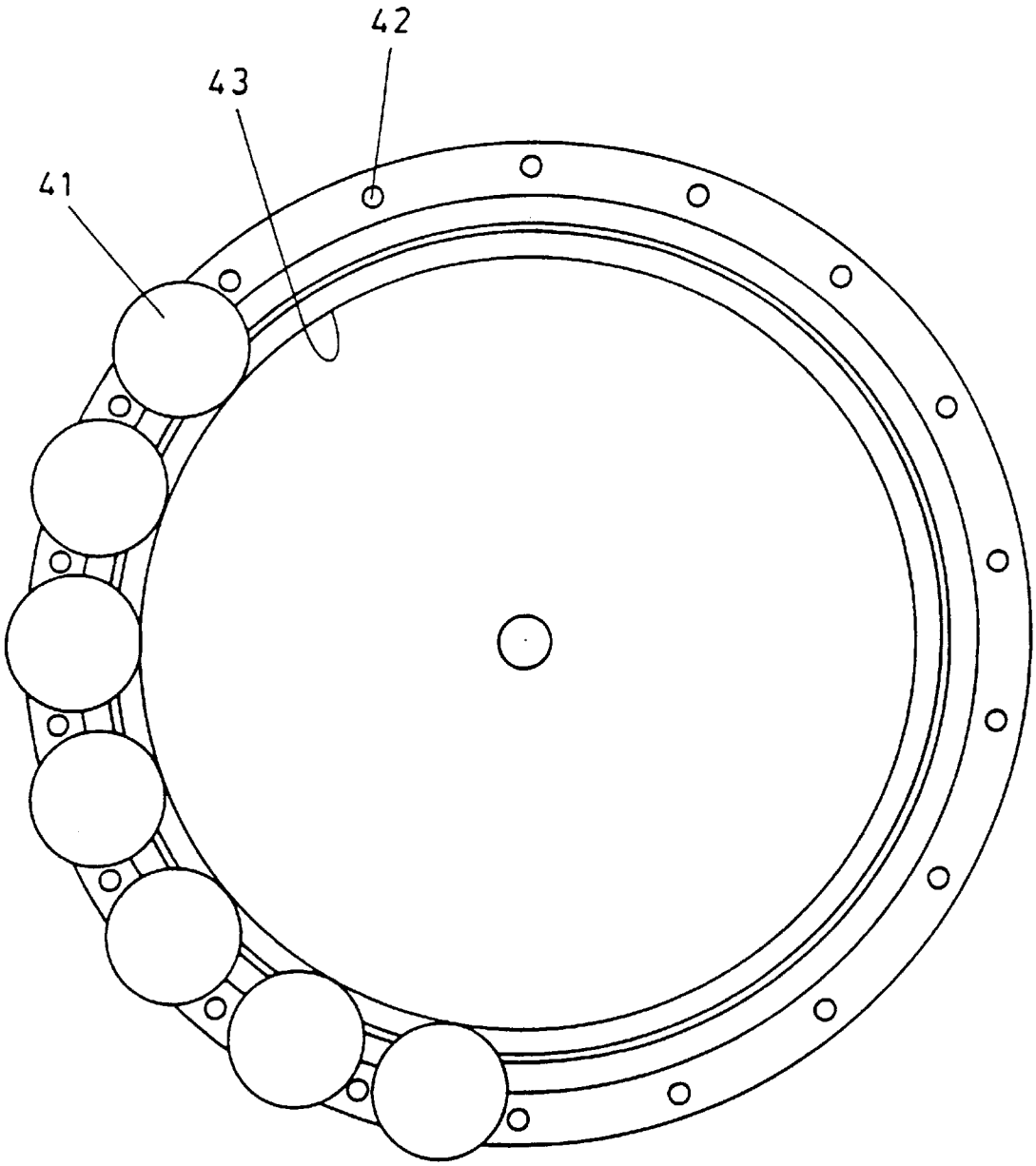
FIG. 11 is a face view of yet another embodiment of the disc according to the invention.

The invention also envisages using a disc of smaller diameter than prior art discs, as shown in FIG. 11. In this arrangement the coins 41 being conveyed by the pegs 42 overhang the perimeter of the disc. Not only does a smaller disc mean lower cost, but it also means that each coin 41 has a smaller distance to travel before it has cleared the disc at the dispensing point.

The coins 41 in FIG. 11 are shown in engagement with a lip 43 on the disc. There is a similar lip 43 on the disc shown in FIG. 9.

The advantage of this lip is that it applies pressure to the rim of a coin, causing the coin to tend to tilt toward the face of the disc, thus assisting in coin retention.

In some circumstances it may not be possible to eliminate entirely the bend shown at 16 in a coin dispensing mechanism of the type shown in FIG. 2.

It will be seen from FIG. 12 that, as coins 44 go round such a bend 45, each coin is pushed by the coin below it. The contact faces between coins are not parallel in the bend region and the result of this is that coins can slide over each other, particularly if they are bent, thus jamming the escalator.

Figure 12:
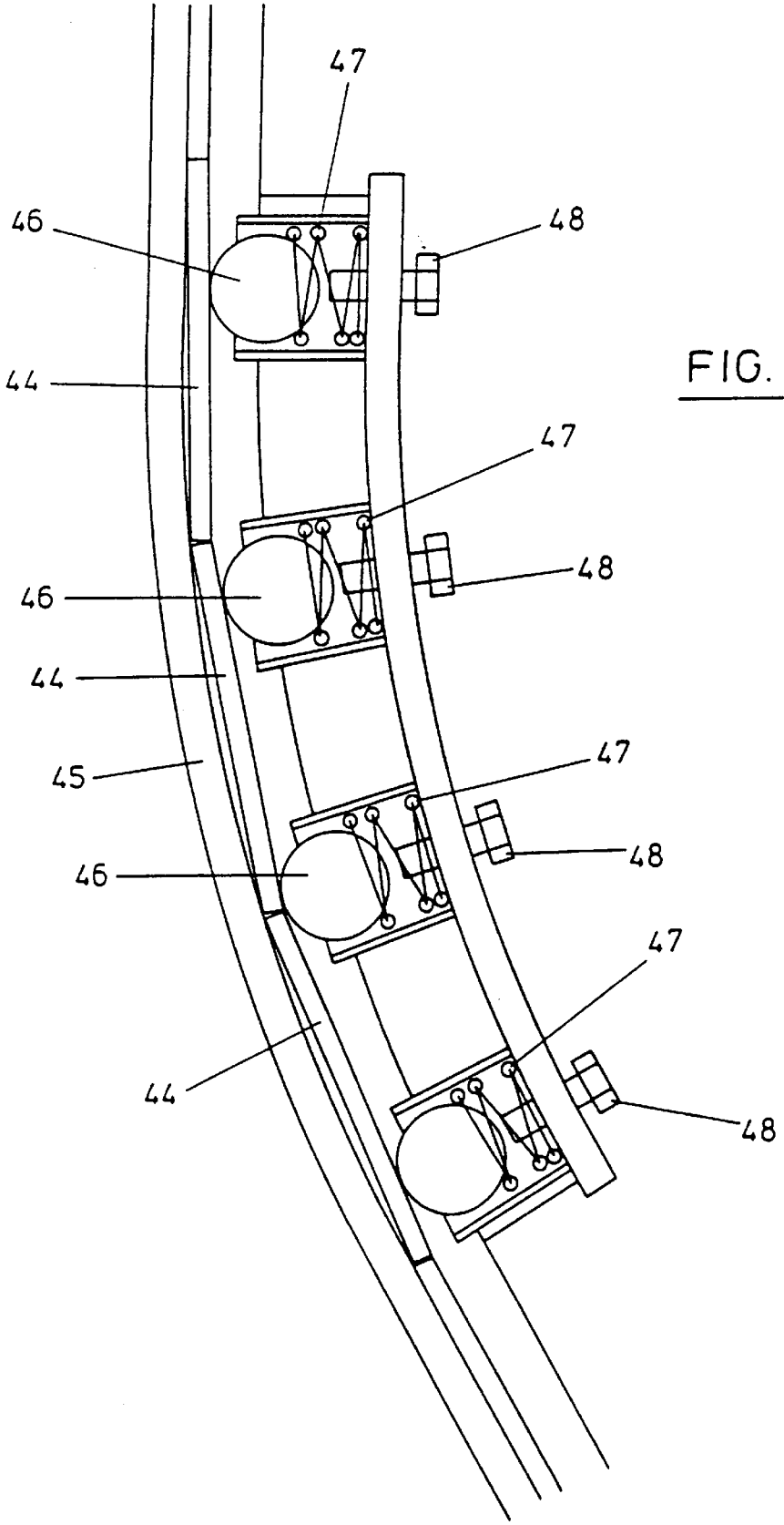
FIG. 12 is a side view of an embodiment of coin escalator according to the invention.

In the embodiment of the invention shown in FIG. 12, the coins are guided for upward movement over a back plate by a series of spring-loaded balls 46.

These balls 46 are mounted centrally in the track, so they act against the full diameter of each coin as it moves past each ball, and in particular they act at the point where the coins engage with each other (see the third ball from the top in FIG. 12) and it will be understood that this is the danger point where coin overlap might try to recur.

FIG. 12 illustrates the use of circular compression springs 47, but as an alternative each ball may be provided with a thin metal pressing having the same effect.

The balls are made of a hard material that resists abrasion, for example heat-treated steel.

Each ball is provided with an adjustable depth stop 48 to limit the travel of each ball. The travel may be limited so that insufficient thickness is available between the back plate and the ball for two coins to fit into. Adjustment may be carried out to fine tune the escalator and to cater for different coin thicknesses.

The balls may be spaced apart by a distance which is smaller than the diameter of a coin. This staggering may help prevent pulsating loads during coin movement.

Although the spring-loaded balls are shown in FIG. 12 as being used to guide the coins round a bend, the balls can be used to restrain coins on straight portions of an escalator as well as curved portions.

Figure 13:
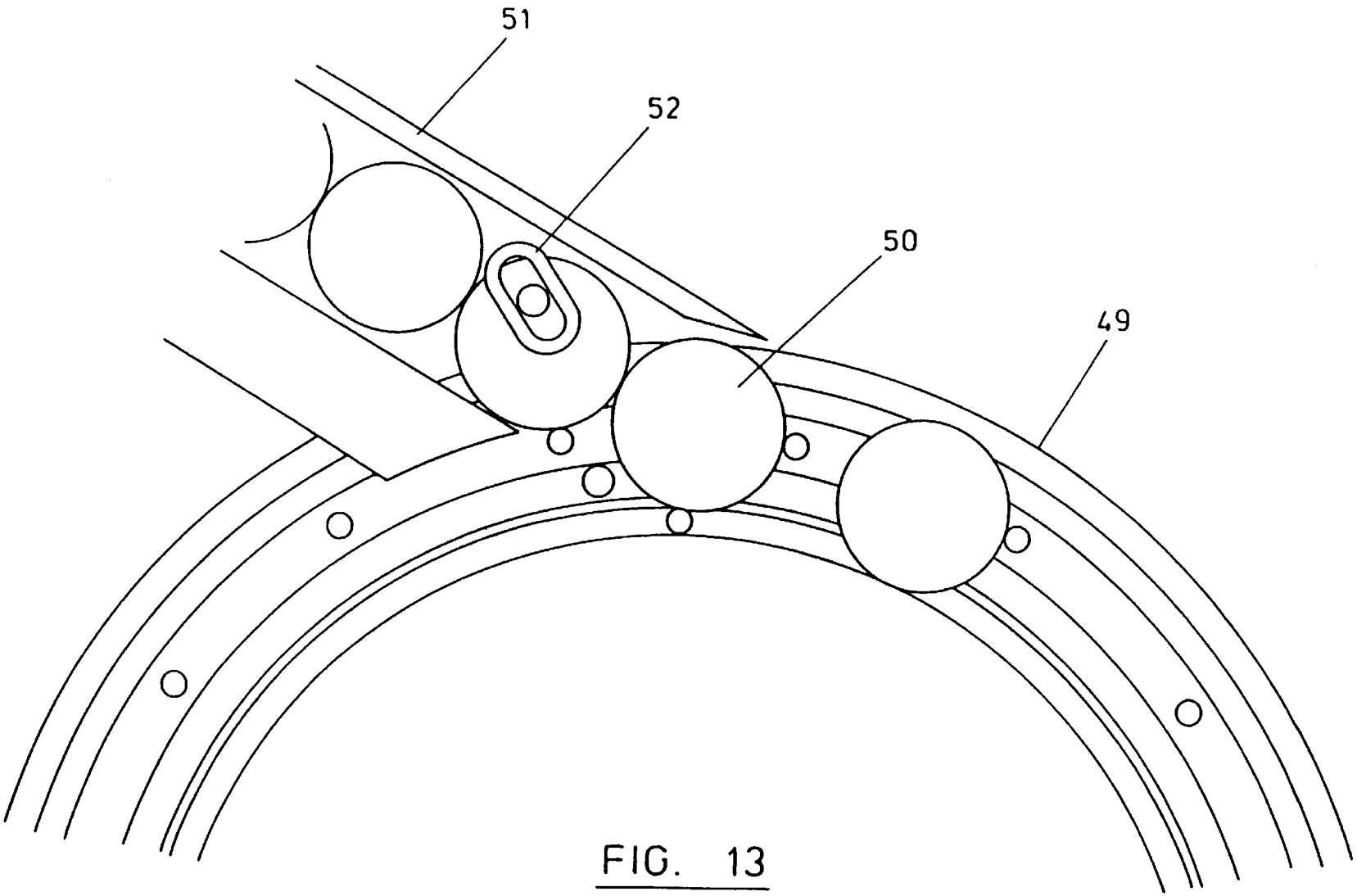
FIG. 13 is a face view of an embodiment of disc according to the invention associated with an embodiment of coin escalator according to the invention.

FIG. 13 illustrates an embodiment of disc 49 according to the invention being utilized to guide coin 50 into the lower part of a coin escalator 51. A sprag clutch 52 is provided which has a wedging action on the coins such that they can travel past the clutch in the upward direction but cannot return in the downward direction. This ensures that the coin escalator does not empty itself of coins if the disc 49 should rotate in the reverse direction to free a jam.

Positioning the clutch as shown in FIG. 13 eliminates the need to use both a stop member 18 and a clutch 19 as shown with the prior art device of FIG. 2.

Figure 14:
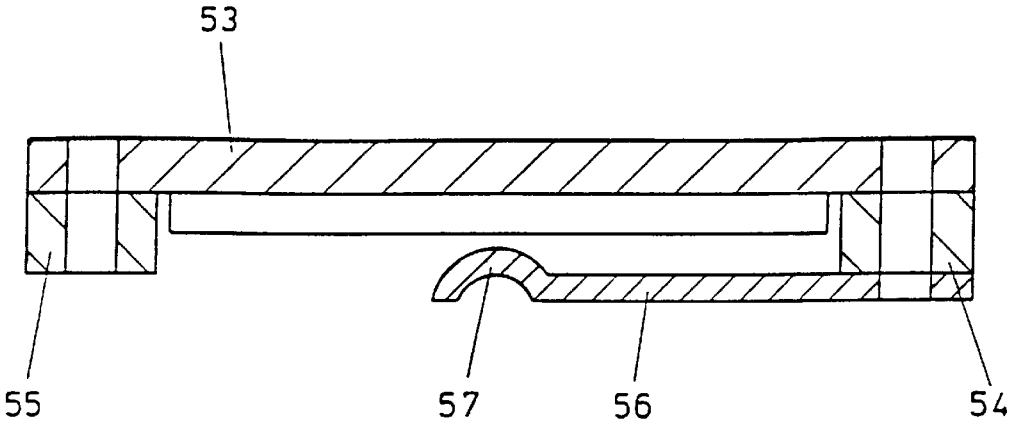
FIGS. 14 to 16 are cross-sectional views through embodiments of coin escalator according to the invention.

FIG. 14 illustrates a novel cross-section of coin escalator for use with the invention. The escalator comprises a channel formed by a base plate 53 and side walls 54 and 55.

The coin escalator shown in FIG. 2 also comprises a channel member but the coins are restrained at opposite edges by two side retaining lips. This type of escalator is very prone to jamming caused by bent coins. Since the coins are restrained at opposite edges, any bend in the coin applies pressure against the base plate with the likelihood of a jam.

With the embodiment of the invention shown in FIG. 14, only one side wall 54 has a retaining strip. This retaining strip 56 extends across slightly more than half of the mouth of the channel, so the coin cannot fall out of the channel, but if the coin is bent, one edge 57 of the coin is free to lift out of the channel to relieve any stress.

Preferably the retaining strip 56 is provided with a projection 57 so that coins are restrained along the center line, where coins touch, rather than at the edges. By controlling the width of this point, it is much more difficult for two coins to slide over each other and jam. Bent and domed coins are less likely to cause a jam.

Figure 15:
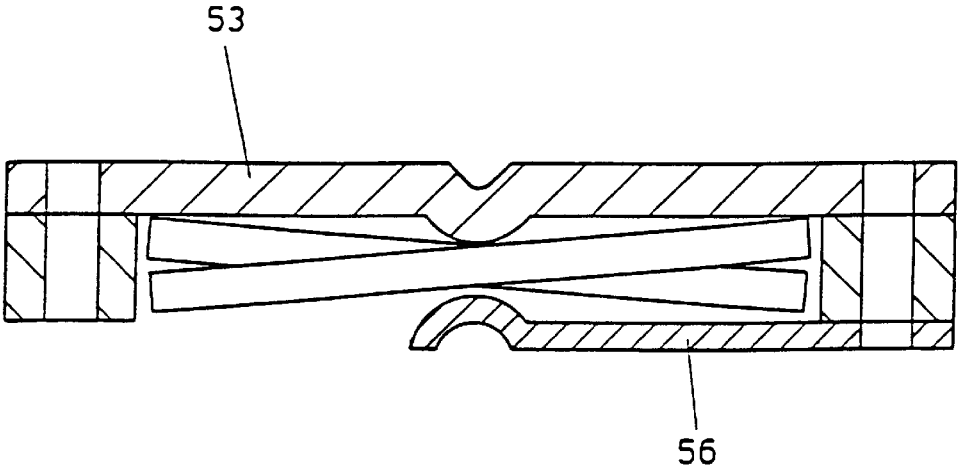

FIG. 15 shows a modification in which there are projections both in the base plate 53 and the retaining strip 56. This may promote rocking of the coins as shown in FIG. 15 and this further reduces the likelihood of jams.

Coins which are slightly twisted relative to each other are less likely to slide over each other.

Figure 16:
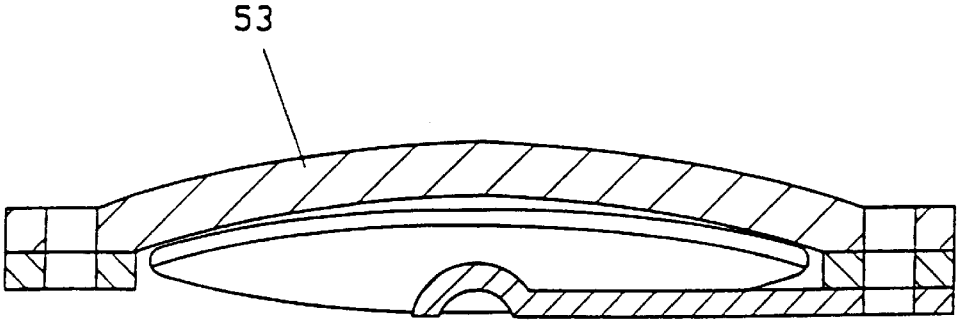

The new profile of coin escalator can be used on straight and curved portions. The modification shown in FIG. 16 is particularly suitable for use on a curved portion where coins are restrained by spring-loaded balls, such as are shown in FIG. 12. In this modification the base plate 53 is curved across its width as well, ideally forming a sphere for the reasons described earlier. This also makes it less likely for the coins to dig into the back plate whilst moving. This not only provides a further ability to accommodate curved coins, but also assists the spring-loaded balls 46 to act effectively.

Figure 17:
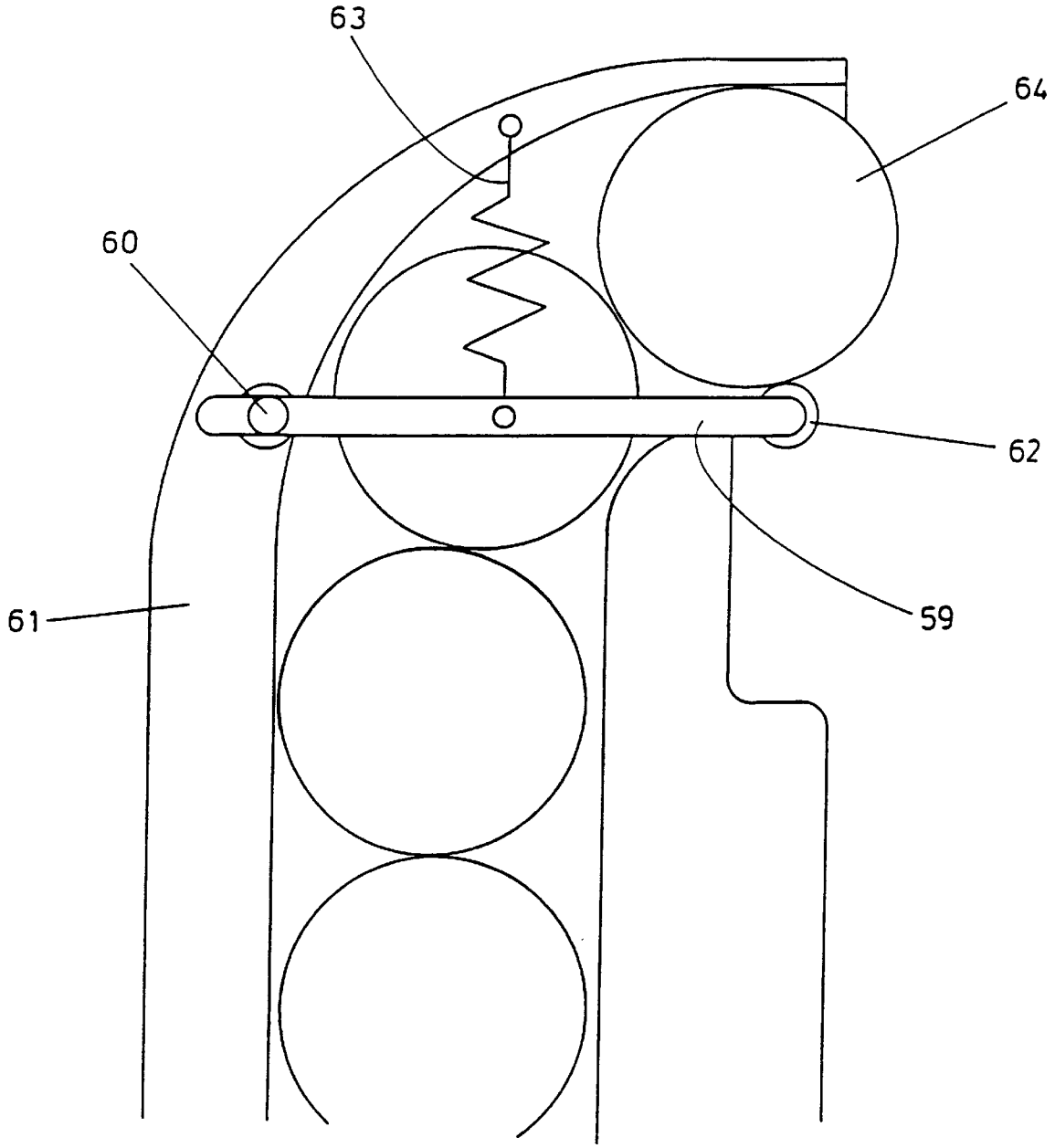
FIG. 17 is a view of the upper end of an embodiment of coin escalator according to the invention.

It is desirable to be able to count coins as they emerge from the top of the escalator. FIG. 17 illustrates a very compact mechanism for doing this.

An arm 59 is pivotally mounted at a point 60 on one side of the escalator track 61. At the other end of the arm a roller 62 extends across the outlet from the track and the arm is urged upwardly by a tension spring 63. As each coin 64 emerges from the escalator, it squeezes over the top of the roller 62, depressing the arm 59, and this depression can be detected in any convenient manner, mechanically or electrically.

Because the arm 59 is mounted on the underside of the coin exit point, the vertical height of the escalator is kept to a minimum, with consequent space-saving advantages in the host machines.

Alternative methods of counting the coins are, however, possible. Means may, for example, be provided a light beam across the coin exit, there being means to detect interruption of this light beam as each coin passes through it.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

What is claimed is:

1. A coin dispensing mechanism comprising:

rotatable plate, a plurality of coin capturing protrusions spaced apart around the plate such that rotation of the plate causes coins to be captured by the protrusions and be conveyed against a face of the plate towards a co-operating stationary guide to guide coins off the plate, the stationary guide having at least one stationary control peg which extends into a co-operating groove in the rotatable plate, the stationary control peg and co-operating groove acting to block a path of each coin in succession, firstly to prevent the coin from becoming jammed between the plate and the stationary guide and secondly to cause the coin to be pushed around the stationary control peg by the moving protrusions, thus directing the coin towards an exit path with the coin remaining in contact with the face of the plate, and a wiping arm, wherein a back of the wiping arm is provided with protrusions which extend into the newly formed space provided by the grooves.

2. A mechanism as claimed in claim 1, wherein the cooperating groove includes one or more concentric grooves provided in a front face of the rotatable plate.

3. A mechanism as claimed in claim 2, in which coins can rest against non-grooved portions of a space for transport in the usual manner.

4. A mechanism as claimed in claim 1, in which part of a back face of the wiping arm has been extended beyond a front face of the rotatable plate.

5. A mechanism as claimed in claim 1, in which a profile of one groove and cooperating protrusion differs from a profile of another groove and protrusion when there is more than one groove and protrusion on the same apparatus.

6. A mechanism as claimed in claim 5, in which the protrusions comprise one or more fixed pegs, arranged to engage in one or more grooves in a manner not only to prevent coins from jamming between the pegs and the rotatable plate but also to restrict movement of a coin so that a coin being dispensed has to move around the pegs towards an exit duct.

7. A mechanism as claimed in claim 6, in which the fixed pegs themselves, and also the way in which they extend across the plate can be adjusted to guide the coins in any desired manner and in particular to adopt a convenient direction for dispensing of the coins from the plate to an exit duct.

8. A mechanism as claimed in claim 1, including a disc arranged to be of dimensions such than the coins that travel around with the disc overhang part of the dispensing circumference.

9. A mechanism as claimed in claim 1 further comprising a coin escalator having a bend therein, with spring-loaded balls being arranged to act on the faces of coins to control the location and movement of the coins as they travel around the bend.

10. A mechanism as claimed in claim 1, further comprising a coin escalator comprising a channel having a base and side walls and a coin retaining strip extending from one of the side walls over the mouth of the channel.

11. A mechanism as claimed in claim 10, wherein a width of the strip is greater than half the width of the channel.

12. A mechanism as claimed in claim 10, wherein the base of the channel is curved in such a manner as to further assist the accommodation of bent coins.

13. A mechanism as claimed in claim 1, further comprising a coin escalator having means to count coins being dispensed from the escalator, the counting means comprising a cooperating signal transmitter and signal receiver.

14. A mechanism as claimed in claim 1, further comprising a coin escalator having means to count coins being dispensed from the escalator, the counting means comprising a mechanical arm positioned such that coins being dispensed travel over the arm and depress the arm outwardly.

15. A coin dispensing mechanism comprising:

rotatable plate, and a cooperating guide to guide coins off the plate, wherein the plate being in the form of a frusto-conical disc having lips.

16. A mechanism as claimed in claim 15, including an escalator used in conjunction with the frusto-conical disc.

* * * * *